US006428149B1

(12) United States Patent
Mizuyama et al.

(10) Patent No.: US 6,428,149 B1
(45) Date of Patent: Aug. 6, 2002

(54) ELECTROSTATIC INK JET RECORDING APPARATUS

(75) Inventors: Yosuke Mizuyama; Masaharu Oyama, both of Fukuoka (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 0 days.

(21) Appl. No.: 09/668,712

(22) Filed: Sep. 22, 2000

(30) Foreign Application Priority Data

Sep. 22, 1999 (JP) ..... 11-268624

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 4,271,416 A 6/1981 Shimizu et al
5,969,732 A * 10/1999 Suetsugu ..... 347/55

FOREIGN PATENT DOCUMENTS

| | | |
|---|---|---|
| JP | 56-4467 | 1/1981 |
| JP | 58-215353 | 12/1983 |
| JP | 8-295023 | 12/1996 |
| JP | 9-193389 | 7/1997 |
| JP | 10-52920 | 2/1998 |
| JP | 9-156106 | 6/1999 |

* cited by examiner

*Primary Examiner*—Raquel Yvette Gordon
(74) *Attorney, Agent, or Firm*—RatnerPrestia

(57) ABSTRACT

An electrostatic ink jet recording apparatus which includes a first electrode which is a recording electrode, a second electrode which is a collecting electrode, and a third electrode which is a common electrode. A potential difference is selectively given between the first and second electrodes for selectively attracting toner particles by electrostatic force. The ink is then ejected and traveled onto a recording medium for printing by applying potential to the third electrode. This configuration prevents dispersion of toner particles while applying ejection signals, enabling to suppress ejection failure and unstable discharge even in high frequency prints.

20 Claims, 8 Drawing Sheets

ELECTROSTATIC INK JET RECORDING APPARATUS

FIELD OF THE INVENTION

The present invention relates to electrostatic ink jet recording apparatuses that achieve stable print density.

BACKGROUND OF THE INVENTION

The ink jet method is an inexpensive, high quality, and high speed printing technology, and is extensively applied to copying machines, facsimile machines, printers, and word processors as an office-use and personal-use recording apparatus.

Ink jet recording systems include types which use an electric-heat converting element such as an exothermic resistor; an electric-mechanical converting element such as a piezo element; and the electrostatic type using electrical energy directly as an energy generator for ejecting toner.

In particular, the manufacture of a recording head for the electrostatic ink jet system is simple compared to those of other systems, and area-wide grayscale recording is achievable by controlling the electrical signals applied to the recording electrode. In addition, the current consumed during recording is extremely small, making it a promising recording technology with respect to energy saving. Furthermore, the use of oil pigment inks offers highly water-proof printing results, which are particularly convenient in an office environment.

The principle of the electrostatic ink jet system is briefly described next.

The Japanese Laid-open Patent No. S56-4467 discloses the principle of ejecting and propelling ink drops from the recording electrode to a counter electrode by applying a few kilovolts of voltage between the recording electrode, which contains the ink, and the counter electrode holding a recording medium. When the electrostatic force applied to the ink becomes higher than the surface tension of the ink, ink drops are ejected and travel from the recording electrode towards the counter electrode.

The typical configuration of a head based on this principle is disclosed in the U.S. Pat. No. 4,271,416 and the Japanese Laid-open Patent No. S56-4467. The disclosed configuration enables the use of a slit for ink ejection shared by multiple recording electrodes which removes the need for a nozzle hole for each recording electrode. The chief advantage of this nozzle-less configuration is the reduction of clogging by dried ink. Accordingly, this configuration is extremely effective for line heads having a recording electrode equivalent in length to the width of the recording medium, as well as a serial head in which some hundreds of recording electrodes scan the recording medium in the width direction.

In the above electrostatic ink jet system having two or more recording electrodes, a closed loop with an adjacent electrode may be created when operating each recording electrode independently. However, the closed loop may result in potential leakage which needs to be prevented. For this purpose, oil-based solvents with high electrical resistance are generally used as ink solvents. The Japanese Laid-open Patent No. S58-215353 uses oil-based ink with a specific resistance of about $10^8$ cm, surface tension 18 of dyne/cm, viscosity of 2–30 cP, and specific gravity of 1.0 g/cm$^3$. Oil-based pigments or oil-based dyes may be used as toners, but oil-based pigments are used more commonly because of their wide variety of types.

However, in the electrostatic ink jet using the above pigment and oil-based solvent, a certain amount of solvent is ejected together with the pigment when ejecting the ink. This leads to limited print density caused by an undesirable ratio of electrostatic charge applied between toner particles and solvent.

The Japanese Laid-open Patent Nos. H8-295023 and H9-19389 attempt to solve this problem by controlling the ratio of force applied to toner particles and solvent with the aim of ejecting only toner particles in the ink. In these prior arts, the ejecting principle is not completely described, but the above problem appears to be solved by applying electrostatic force only to the toner particles dispersed in the solvent with the aim of ensuring that only the toner particles are ejected and that no solvent accompanies them in ejected ink. In order to achieve the independent movement of the toner particles and solvent, the toner particles need to be dispersed rather than dissolved in the solvent. This is because that if the toner is dissolved, the toner particles and solvent cannot be distinguished to then selectively eject only the toner particles.

The Japanese Laid-open Patent No. H8-295023 applies a voltage with the same polarity as the polarity of the charge of the toner particles to the recording electrode so that only the toner particles migrate and are attracted to the tip of the recording electrode by electrostatic repulsion. Ink drops containing a high density of toner particles are then ejected.

However, as described in the Japanese Laid-open Patent No. H10-52920, the electrostatic repulsion from the recording electrode applies a three-dimensional repulsion to toner particles. This results in the toner particles being attracted to the meniscus in areas where a meniscus is present, but, on the other hand, results in dispersion of toner particles in other areas distant from the meniscus. Consequently, toner particles to be supplied in the next ejection becomes insufficient, causing an extremely low toner particle density at the ink ejection opening, and thus markedly reducing the print density. In extreme cases, toner particles may not be ejected at all. This problem may occur when there is a single recording electrode, but becomes more serious when a so-called slit head having two or more recording electrodes and a common ink ejection opening is used. The problem becomes even more critical with increasing width of the ink ejection opening. A so-called full-line head whose ink ejection opening is long in the width direction of the recording medium may suffer this problem particularly obviously. This is because the dispersion is more likely to occur when the space allowing dispersal of toner particles is larger.

In order to solve the above problem, the Japanese Laid-open Patent No. H9-156106 proposes the following method: A potential difference is applied between the recording electrode and its adjacent electrode for attracting toner particles near the recording electrode, and the recording signals are supplied to the recording electrode while the toner particles are being attracted.

FIG. 5 is a perspective view of an electrostatic ink jet head in a preferred embodiment of the present invention. A conventional control system is described with reference to FIG. 5 for convenience. FIGS. 10 and 11 are timing charts illustrating the control system of a conventional electrostatic ink jet head.

In FIG. 5, the ink jet head comprises recording electrodes 11, collecting electrodes 12, upper plate 4, and lower plate 5; and contains ink 6. Electrodes selected for printing in recording electrodes 11 are hatched. A higher potential is applied to collecting electrode 12 compared to that applied to recording electrode 11 for attracting positively charged pigment to recording electrode 11. The positive pulse signal applied to recording electrode 11 enables ink to be ejected from ink ejection opening 8 as a result of electrostatic repulsion.

In FIG. 10, signal 301 is applied to the recording electrodes for printing. Signal 302 is applied to the collecting electrodes. Signal 303 is applied to a counter electrode. In FIG. 11, signal 304 is applied to the recording electrodes not being used for printing.

In FIG. 10, the electrostatic potential (signal 302) of the collecting electrodes is High while the voltage of the recording electrodes (signal 301) is Low so that positively charged pigment is attracted to and migrates towards the recording electrodes. Then, when the voltage of the recording electrode is raised, the pigment attracted to the recording electrodes for printing is ejected and travels from the recording electrode by electrostatic repulsion. On the other hand, since the High signal is not applied to the recording electrodes not being used for printing (signal 304 stays low), the ink is not ejected from these recording electrodes.

This method, however, still causes dispersion of toner particles during the ON period when the voltage of the recording electrodes for printing is High, due to there being small or no potential difference between the recording electrodes and collecting electrodes during this period. This may inhibit the improvement of the recording speed, disable the ejection of large dots, and prevent stable ejection.

SUMMARY OF THE INVENTION

The present invention aims to offer an electrostatic ink jet recording apparatus for solving the above problems in the prior art.

The electrostatic ink jet recording apparatus of the present invention comprises:

(a) a first electrode;

(b) a second electrode; and (c) a third electrode.

Potential difference is selectively applied between the first and second electrodes for selectively attracting toner particles by electrostatic force, and the ink is ejected and travels to print on a recording medium by giving potential to the third electrode.

This configuration solves the conventional problems caused by dispersion of the toner particles while applying the recording signals, including decreased recording speed, no ejection of large dots, and unstable ejection.

DESCRIPTION OF THE PREFERRED EMBODIMENT

Exemplary embodiments of the present invention are described below with reference to drawings.

First Exemplary Embodiment

Figure 1:
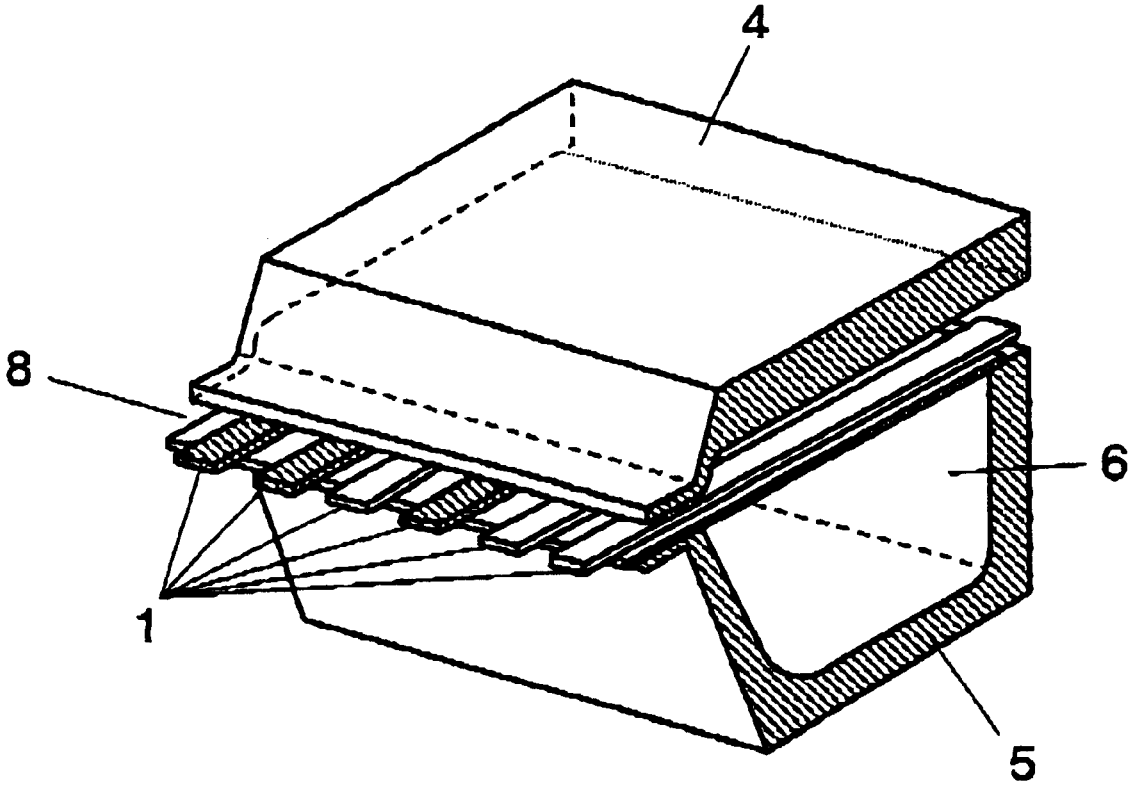
FIG. 1 is a perspective view of an electrostatic ink jet head in accordance with a first exemplary embodiment of the present invention.
Figure 2:
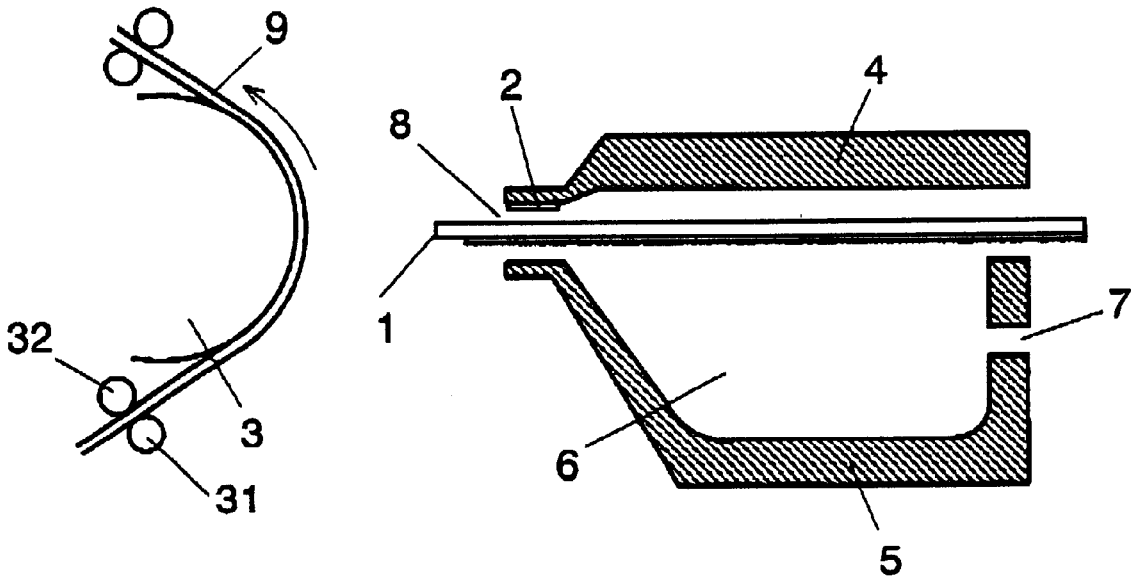
FIG. 2 is a sectional view of the electrostatic ink jet head in accordance with the first exemplary embodiment of the present invention.
Figure 3:
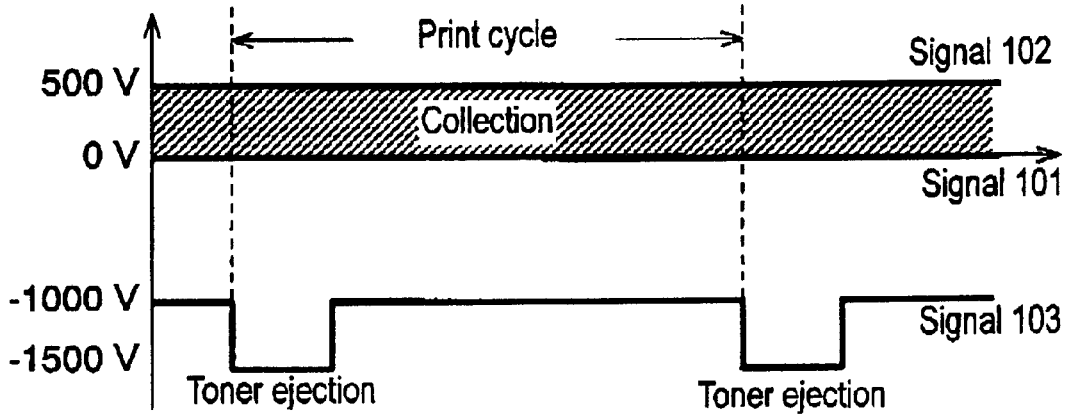
FIGS. 3 and 4 are timing charts illustrating a control system of the electrostatic ink jet head in accordance with the first exemplary embodiment of the present invention.
Figure 4:
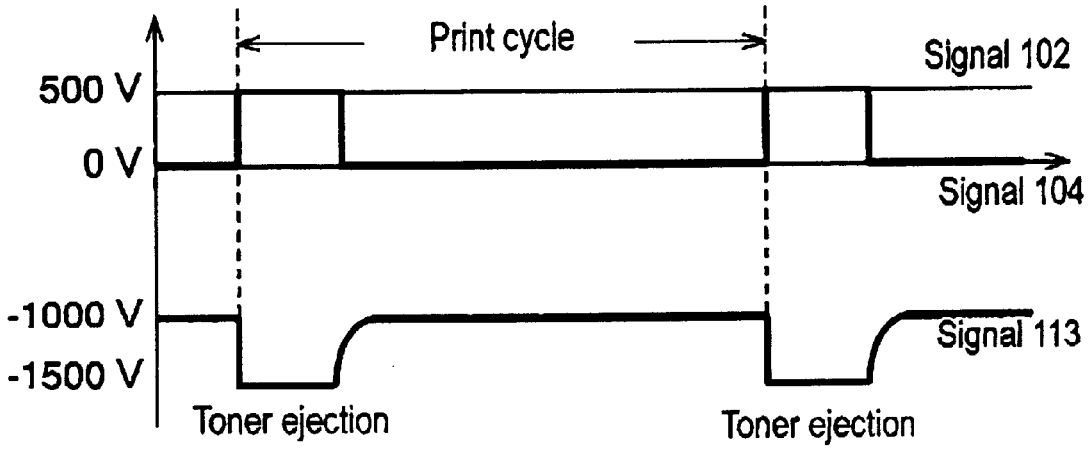

FIG. 1 is a perspective view, FIG. 2 is a sectional view, and FIGS. 3 and 4 are timing charts illustrating a control system of an electrostatic ink jet head in the first exemplary embodiment of the present invention.

In FIGS. 1 and 2, an ink jet head in the electrostatic ink jet recording apparatus comprises recording electrode 1 (first electrode), collecting electrode 2 (second electrode), top plate 4, and lower plate 5; and contains ink 6.

There are two or more independent recording electrodes 1 in the electrostatic ink jet head, and each recording electrode 1 is connected to a driver (not illustrated) for applying the electrostatic potential respectively. In the first exemplary embodiment, for example, 256 recording electrodes 1 are provided for 300 dpi recording density. A first driver selectively applies the electrostatic potential to an electrode for ejecting ink (hereafter referred to as the selected electrode) in the recording electrodes in accordance with print data signals sent from the printer driver (not illustrated) provided in the main unit of the printer. In FIG. 1, the selected electrode is hatched, and a controller is provided on the apparatus for controlling the first driver (not illustrated). This controller also controls the second and third drivers described later.

A voltage for attracting the pigment around recording electrodes 1 is applied to the collecting electrode 2. A higher potential than that applied to recording electrodes 1 is applied to collecting electrode 2 when the pigment is positively charged, as in the first exemplary embodiment. Collecting electrode 2 may be independently provided in numbers of two or more, or as a common electrode. The electrostatic potential is applied by providing a second driver. Alternatively, the first driver may be provided between recording electrodes 1 and collecting electrode 2 to operate collecting electrode 2 by means of the potential difference.

The ink jet recording apparatus in the first exemplary embodiment has a cylindrical common electrode 3 (third electrode) facing the ink jet head, as shown in FIG. 2. This common electrode 3 is configured as a platen so that recording medium 9 may be set on the common electrode 3. In addition, the surface or inside of common electrode 3 is formed of a conductive material at least for the portion where recording medium 9 contacts so that common electrode 3 functions as a third electrode. A third driver (not illustrated) provides electrostatic potential to common electrode 3. As for the shape of the platen, a flat platen is also applicable. Rollers 31 and 32 are provided upstream of the transfer direction of recording medium 9 with respect to common electrode 3 for sandwiching recording medium 9 and transferring it toward common electrode 3. At least one of rollers 31 and 32 is formed with a conductive material and grounded thereby neutralizing the charge on transferred recording medium 9. Removal of the charge thus enables the suppression of changes in the potential difference between common electrode 3 and recording electrodes 1 due to buildup of electrostatic charge on recording medium 9, thus realizing stable recording characteristics.

Ink supply opening 7 supplies the ink to a chamber provided between upper plate 4 and lower plate 5 for storing the ink. Ink ejection opening 8 ejects the ink from the chamber by applying the recording voltage between recording electrodes 1 and common electrode 3.

In the first exemplary embodiment, the distance between recording electrodes 1 and common electrode 3 is set to about 0.4 mm. However, a distance from 0.2 to 3 mm is acceptable for preventing problems such as deviation of recording position by interference to achieve satisfactory print quality. The distance between recording electrode 1 and collecting electrode 2 is about 80 $\mu$m in the first exemplary embodiment, but a 30–500 $\mu$m distance is acceptable for attracting the pigment in a satisfactory way to facilitate the formation of large pigment dots.

Next, signals applied to recording electrode 1, collecting electrode 2, and common electrode 3 are described.

FIG. 3 shows signal 101 applied to the selected electrode for ejecting the ink in recording electrodes 1, signal 102 is applied to collecting electrode 2, and signal 103 is applied to common electrode 3. FIG. 4 shows signal 104 applied to non-selected electrodes not being used for ink ejection in recording electrodes 1, signal 102 applied to collecting electrode 2 and signal 113 applied to common electrode 3.

First, as shown at the left end of FIG. 3, the electrostatic potential of recording electrodes 1 is set to lower than that of collecting electrode 2 disposed at the end of upper plate 4 at the side of ink ejection opening 8 before ink ejection signals reach recording electrodes 1. At this point, the positively charged pigment kept being attracted to and migrates towards recording electrodes 1 to maintain the threshold state for ejection. The potential of recording electrodes 1 is indicated as 0 V for convenience, but it may be set to any level required as dictated by collecting electrode 2 and common electrode 3 (potential difference between signal 102 and signal 103). However, the pigment is satisfactorily attracted to recording electrode 1 by setting the potential difference between recording electrode 1 and collecting electrode 2 to 10 to 500 V. A negative DC current (first value), such as −1000 V, is applied to common electrode 3 for maintaining the state immediately before ejecting the ink meniscus. The potential difference between collecting electrode 2 and common electrode 3 is preferably set to 1000 V–2000 V so that the ink is not actually ejected.

Next, when the ink ejection signals reach recording electrodes 1, a second negative pulse voltage whose absolute value is larger than the first value, such as −1500 V, is applied to common electrode 3. The potential of the selected electrode in recording electrodes 1 is maintained at the same level, and signal 104 shown in FIG. 4 is applied to the non-selected electrode in recording electrodes 1. Signal 104 is set to reduce or eliminate the potential difference with collecting electrode 2 to reduce collection of the pigment. Accordingly, the pigment is not ejected from the non-selected electrode, but from the selected electrode where the pigment remains an attractive force by electrostatic attraction with common electrode 3.

The level of the second negative pulse is set preferably to have a potential difference of 300 V–3000 V with respect to the first value. This range assures that pigment is ejected from the selected electrode and also suppresses vibration of the meniscus on completion of ejection. Accordingly, the apparatus can immediately shift and prepare for the next print. In addition, pigment leakage from the non-selected electrode may be suppressed.

As shown by signal 113 in FIG. 4, the latter edge of the second negative pulse signal applied to common electrode 3 is preferably changed dully or gently compared to the former edge. Such control enables the suppression of vibration of ink meniscus which may occur as a result of a sudden voltage fluctuation at common electrode 3, improving the print speed by means of improved response frequency.

In addition, the electrostatic potential of the non-selected electrode in recording electrodes 1 is maintained close to the electrostatic potential of collecting electrode 2. When there are two or more collecting electrodes 2 corresponding to recording electrodes 1, the electrostatic potential of each of the collecting electrodes 2 corresponding to the non-selected electrodes may be maintained at close to the electrostatic potential of recording electrodes 1.

Describing the above signal control more specifically, signal 101 in FIG. 3 is applied to the selected electrode in recording electrodes 1; signal 104 in FIG. 4 is applied to the non-selected electrode in recording electrodes 1; the DC voltage of signal 102 in FIGS. 3 and 4 is applied to collecting electrode 2, and signal 103 or 113 is applied to common electrode 3.

Signal 101 applied to the selected electrode is 0 V, which means signal 101 is always ground. On the other hand, a 2 kHz frequency, 200 $\mu$s ON time, and a 500 V pulse waveform are applied to the non-selected electrode. Signal 102 applied to collecting electrode 2 is at a voltage of 500 V DC. Accordingly, the pigment is always attracted to the selected electrode at least during a single print cycle (in this case 500 $\mu$s). The pigment is attracted to the non-selected electrode during the non-ink ejection period (300 $\mu$s), but the pigment disperses during the ink ejection period (200 $\mu$s).

Signal 103 or 113 applied to the common electrode has a −500 V pulse waveform based on 2 kHz frequency, 200 $\mu$s ON time, and −1000 V bias voltage. When the pulse voltage of signal 103 or 113 is applied, the electric field directed from recording electrodes 1 to common electrode 3 becomes large, and forms ink drops corresponding to the length of 200 $\mu$s for ejection from selected recording electrodes 1. In this case, compared to the prior art, ejection failure and unstable ejection are not observed at 2 kHz recording frequency. Moreover, 90 $\mu$m instead of 50 $\mu$m dot diameter at the 200 $\mu$s is ON time in the prior art is achievable.

The characteristic of the present invention is that the potential difference between recording electrode 1 and collecting electrode 2 does not change in the selected electrodes; thus the toner particles are always attracted.

In the above description, the pigment is considered to be positively charged. It is apparent that the pigment may also be negatively charged. In that case, all the potential relations described are naturally reversed.

The above control system makes it possible to always achieve a potential gradient between collecting electrode 2 and recording electrodes 1. Since this potential gradient remains unchanged, dispersion which occurs during the ON period in the conventional system of turning ON and OFF signals applied to the recording electrodes may be solved.

The structure of the common electrode is not limited as long as ink drops are ejected toward the recording medium. For example, a grid may be provided near the first or second electrode. The position, number, and structure of the collecting electrode are also not limited as long as the toner particles are attracted to the recording electrode.

In FIGS. 3 and 4, the ON timing of signal 103 or 113 is synchronized with the ON timing of signal 104. However, the ON timing of signal 104 may be set earlier than that of signal 103 or 113.

Second Exemplary Embodiment

Figure 5:
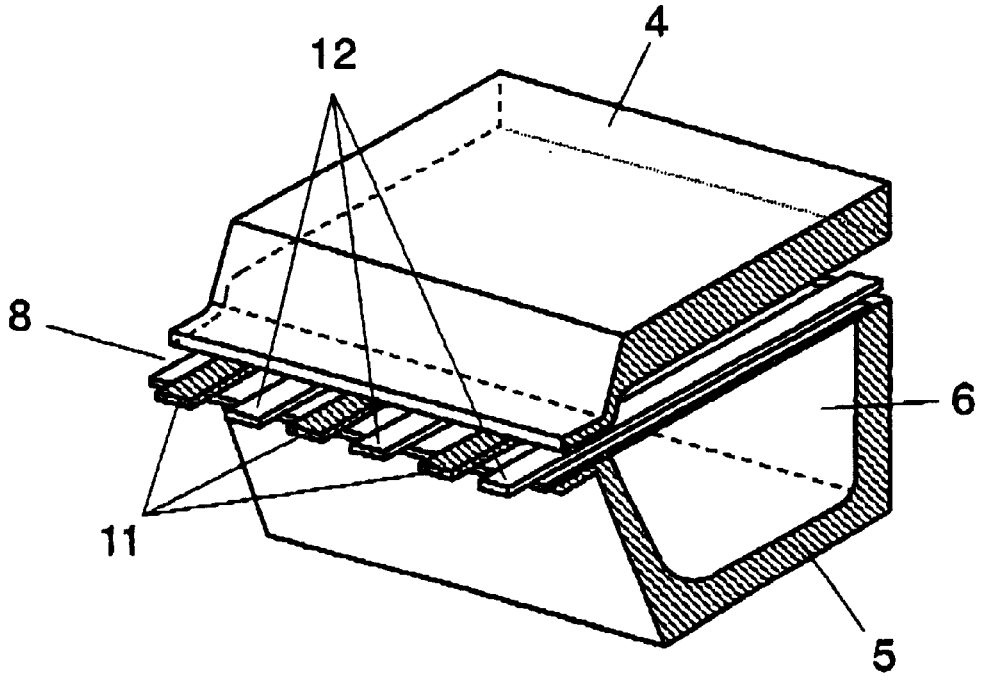
FIG. 5 is a perspective view of an electrostatic ink jet head in a second exemplary embodiment of the present invention.

FIG. 5 is a perspective view of an electrostatic ink jet head in the second exemplary embodiment of the present invention.

The edge head shown in FIG. 5 has 300 dpi electrode density and 256 electrodes, and is controlled in the way described in FIGS. 3 and 4. Even-numbered electrodes of the 256 electrodes are fixed to recording electrodes 11, and odd-numbered electrodes are fixed to collecting electrodes 12. Both electrodes are adjacent to each other on the same plane. A common electrode is made of a metallic platen (not illustrated) disposed on the rear side of the recording paper. With this configuration, ink drops are printed at a recording density of 150 dpi.

In the second exemplary embodiment, the pigment is attracted to recording electrodes 11. On the other hand, the pigment is not attracted to collecting electrodes 12, and metal tarnish of the electrodes is observed. When a pulse is applied to the common electrode, ink drops are ejected only from the selected electrodes in recording electrodes 11, improving the ejection responsivity and creating a smaller dot diameter. Compared to the prior art, ejection failure and unstable ejection are also improved. Furthermore, the provision of collecting electrodes 12 near recording electrodes 1 enables a sufficient effect to be achieved with small potential difference between both electrodes. Since both electrodes may be formed on the same plane at the same time, the second exemplary embodiment also makes it possible to manufacture the head at lower cost.

Third Exemplary Embodiment

Figure 6:
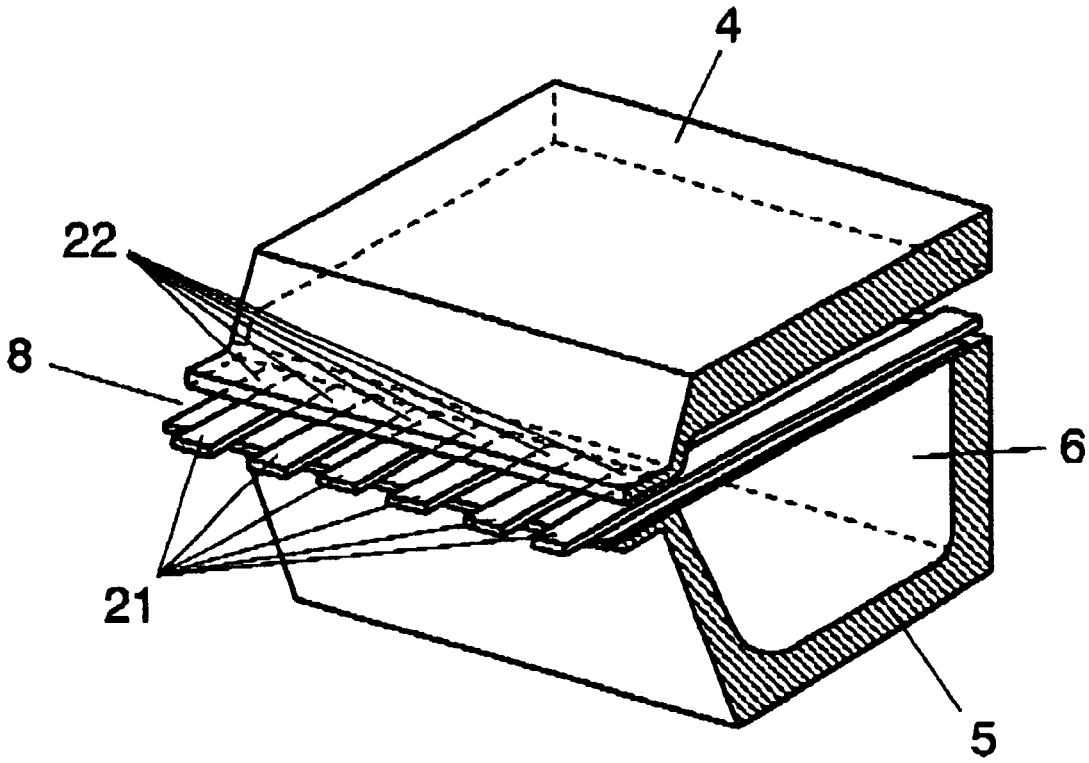
FIG. 6 is a perspective view of an electrostatic ink jet head in a third exemplary embodiment of the present invention.

FIG. 6 is a perspective view of an electrostatic ink jet head in the third second exemplary embodiment of the present invention.

The edge-type head shown in FIG. 6 has 300 dpi electrode density and 256 electrodes, and is controlled in the way described in FIGS. 3 and 4. All 256 electrodes are recording electrodes 21, and collecting electrodes 22 are disposed on the top and bottom of the ink ejection opening in a way to vertically sandwich each of recording electrodes 21. A common electrode is made of a metallic platen (not illustrated) disposed on the rear side of the recording paper. In other words, collecting electrodes 22 are adjacent to recording electrodes 21 on a plane vertical to the recording electrodes 21. With this configuration, ink drops are printed at a recording density of 300 dpi.

Printing with the above electrode configuration enables to improve ejection failure and unstable ejection, compared to the prior art. Furthermore, provision of collecting electrodes 22 vertical to recording electrodes 21 enables to maximize electrode alignment density of recording electrodes 21.

Fourth Exemplary Embodiment

Figure 7:
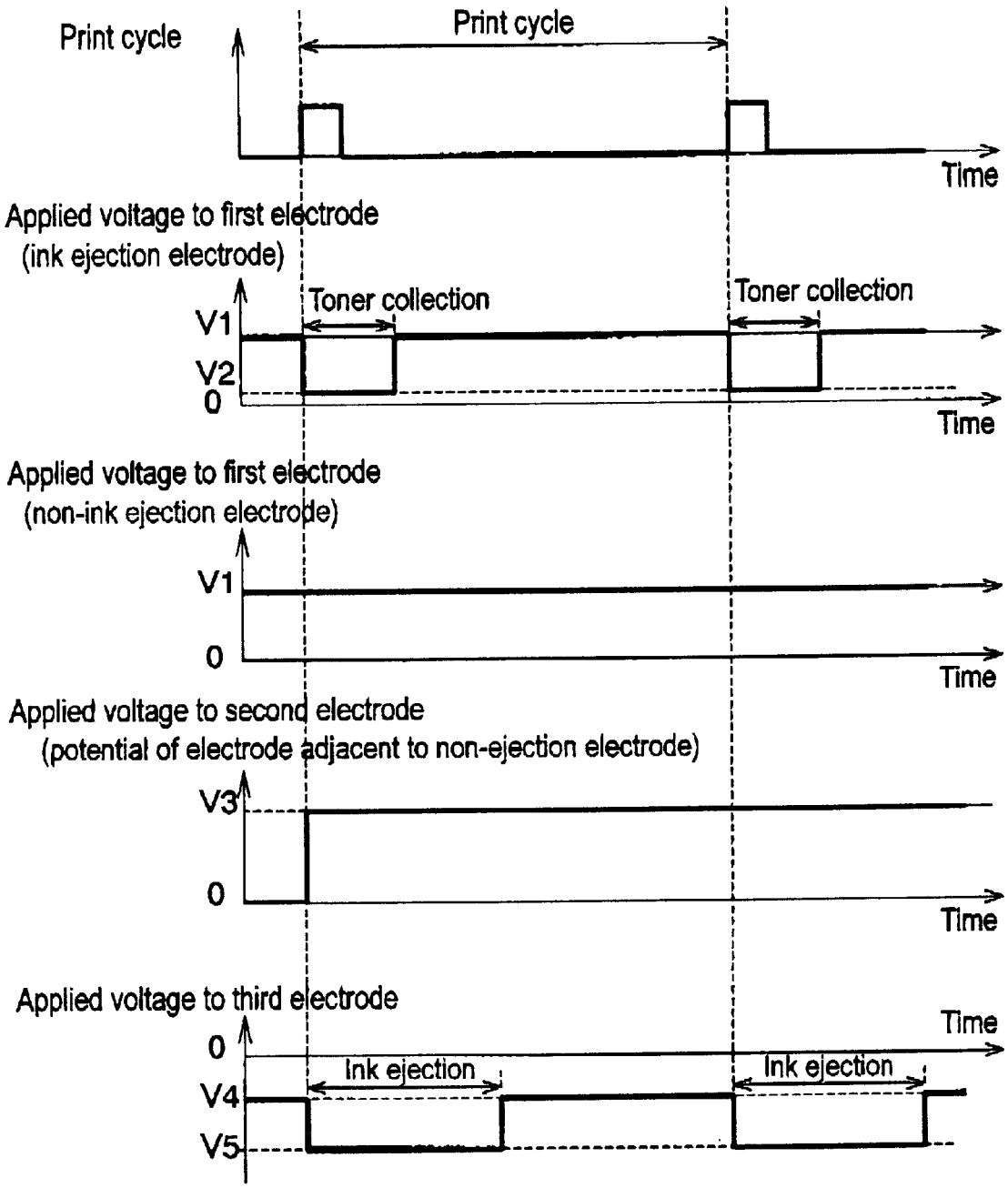
FIG. 7 illustrates control signals of an electrostatic ink jet head in accordance with a fourth exemplary embodiment of the present invention.

FIG. 7 illustrates control signals for an electrostatic ink jet head in the fourth exemplary embodiment of the present invention.

The configuration of the ink jet head described in the first to third exemplary embodiments is applicable to the fourth exemplary embodiment.

Positive bias voltage V1 is applied to recording electrodes 1, 11, and 21 when toner particles are not being attracted. During the attraction of toner particles, signal voltage V2, which is lower than bias voltage V1, is applied to the electrode for ejecting ink (selected electrode), and signals are not applied to electrodes which will not eject ink.

Positive bias voltage V3 is always applied to collecting electrodes 2, 12, and 22, and the toner particles are attracted to the selected electrodes by the potential difference between the selected electrodes and collecting electrodes, while signal voltage V2 is applied to the recording electrodes for creating a threshold state of ink ejection.

Negative bias voltage V4 is applied to common electrode 3 except during the ink ejection period. Signal voltage V5, which is lower than bias voltage V4, is applied to common electrode 3 during the ink ejection period.

When signal voltage V5 is applied to the common electrode at the point when the ink ejection threshold state is prevailing at the selected electrodes, the ink is ejected as a result of the electrostatic attraction.

This control system enables the effective use of a driver IC which outputs negative pulse signals.

Signal voltage V2 may be the ground voltage or lower. In addition, the relation between signal voltage V2 and bias voltage V3 is preferably V2<V3, and the potential difference between V2 and V3 is preferably 10 V–500 V for achieving satisfactory attraction of toner particles.

The level relation between bias voltage V1 and bias voltage V3 is not specified. For achieving a large attraction rate for toner particles, the relation of V1<V3 is preferable. For achieving stable print quality by avoiding excess attraction of toner particles by a relatively small attraction rate, the relation is preferably V3, V1.

Furthermore, bias voltage V4 may be the ground voltage. Ideally, signal voltage V5 has a potential difference of 300 V–800 V with respect to bias voltage V4. The potential difference within this range enables the provision of sufficient energy for ejecting ink, thus securing stable print quality.

Fifth Exemplary Embodiment

Figure 8:
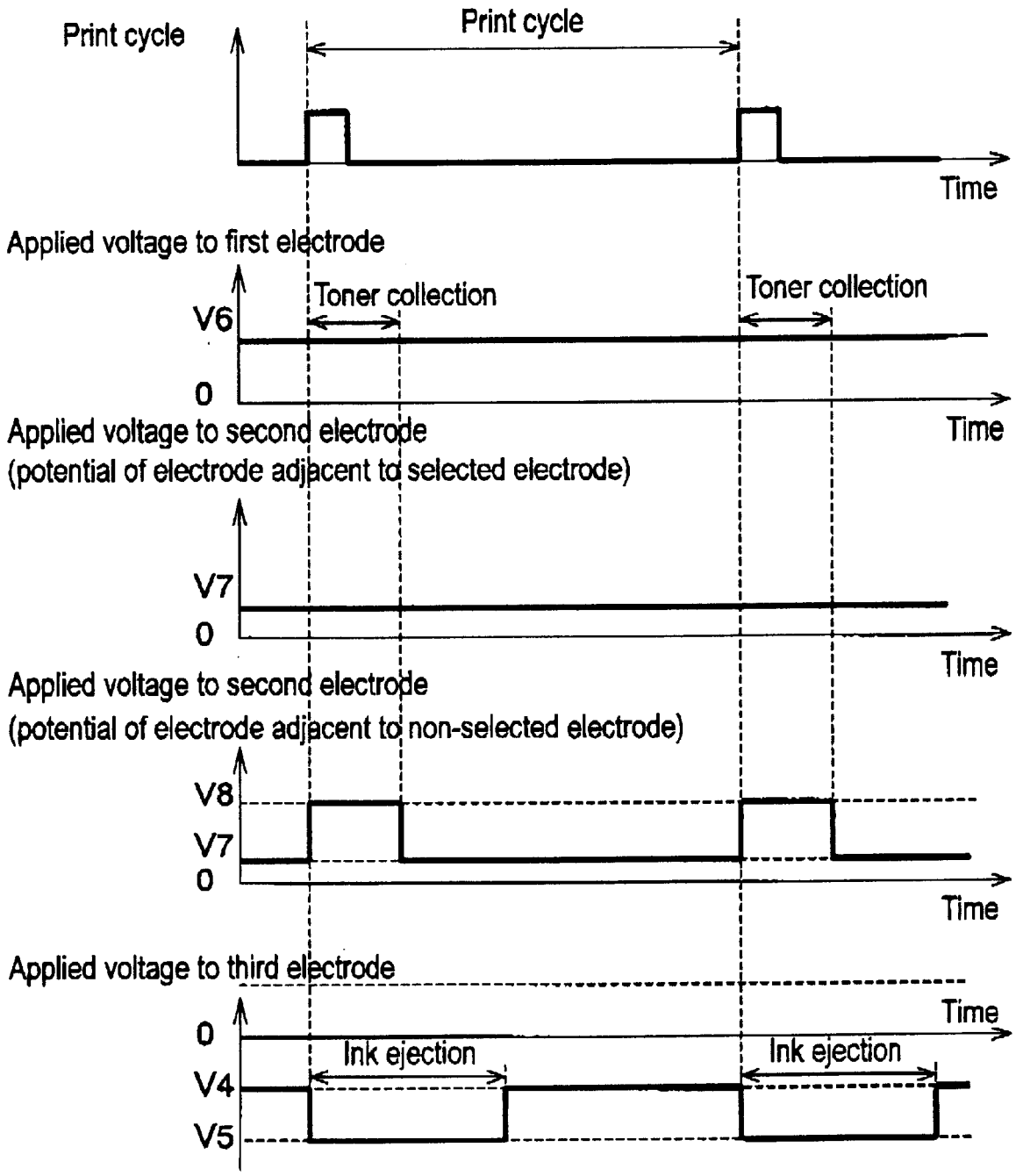
FIG. 8 illustrates control signals of an electrostatic ink jet head in accordance with a fifth exemplary embodiment of the present invention.

FIG. 8 illustrates control signals for an electrostatic ink jet head in the fifth exemplary embodiment of the present invention.

The configuration of the ink jet head described in the first to third exemplary embodiments is applicable to the fifth exemplary embodiment.

Positive bias voltage V6 is always applied to recording electrodes 1, 11, and 21.

Bias voltage V7 is always applied to collecting electrodes 2, 12, 22 adjacent to recording electrodes for ink ejection (selected electrodes). Bias voltage V7 is applied to collecting electrodes which are adjacent to recording electrodes not for ink ejection. When the ink is ejected, signal voltage V8 higher than bias voltage V7 is applied to these collecting electrodes adjacent to recording electrodes not for ink ejection.

Accordingly, a potential difference is generated between selected electrodes in recording electrodes and collecting electrodes adjacent to selected electrodes when signal voltage V8 is applied, creating a threshold state of ink ejection by concentrating toner particles.

Negative bias voltage V4 is applied to common electrode 3 except during the ink ejection period. Signal voltage V5, which is lower than bias voltage V4, is applied to common electrode 3 during the ink ejection period.

When signal voltage is applied to the common electrode at the point when the ink ejection threshold state is prevailing at the selected electrodes, the is ejection as a result of the electrostatic attraction.

This control system enables the effective use of a driver IC which outputs positive pulse signals. Bias voltage V7 may be the ground voltage or lower.

In addition, the relation between signal voltage V6 and bias voltage V7 is preferably V7<V6, and the potential difference between V7 and V6 is preferably 10 V–500 V for achieving satisfactory attraction of toner particles.

The level relation between signal voltage V8 which is a pulse voltage and bias voltage V7 is preferably V7<V8, but any potential relation is acceptable as long as the potential difference of 10 V–500 V is achieved.

Furthermore, bias voltage V4 may be the ground voltage. Ideally, signal voltage V5 has a potential difference of 300 V–800 V with respect to bias voltage V4. The potential difference within this range enables the provision of sufficient energy for ejecting ink, thus securing stable print quality.

Sixth Exemplary Embodiment

Figure 9:
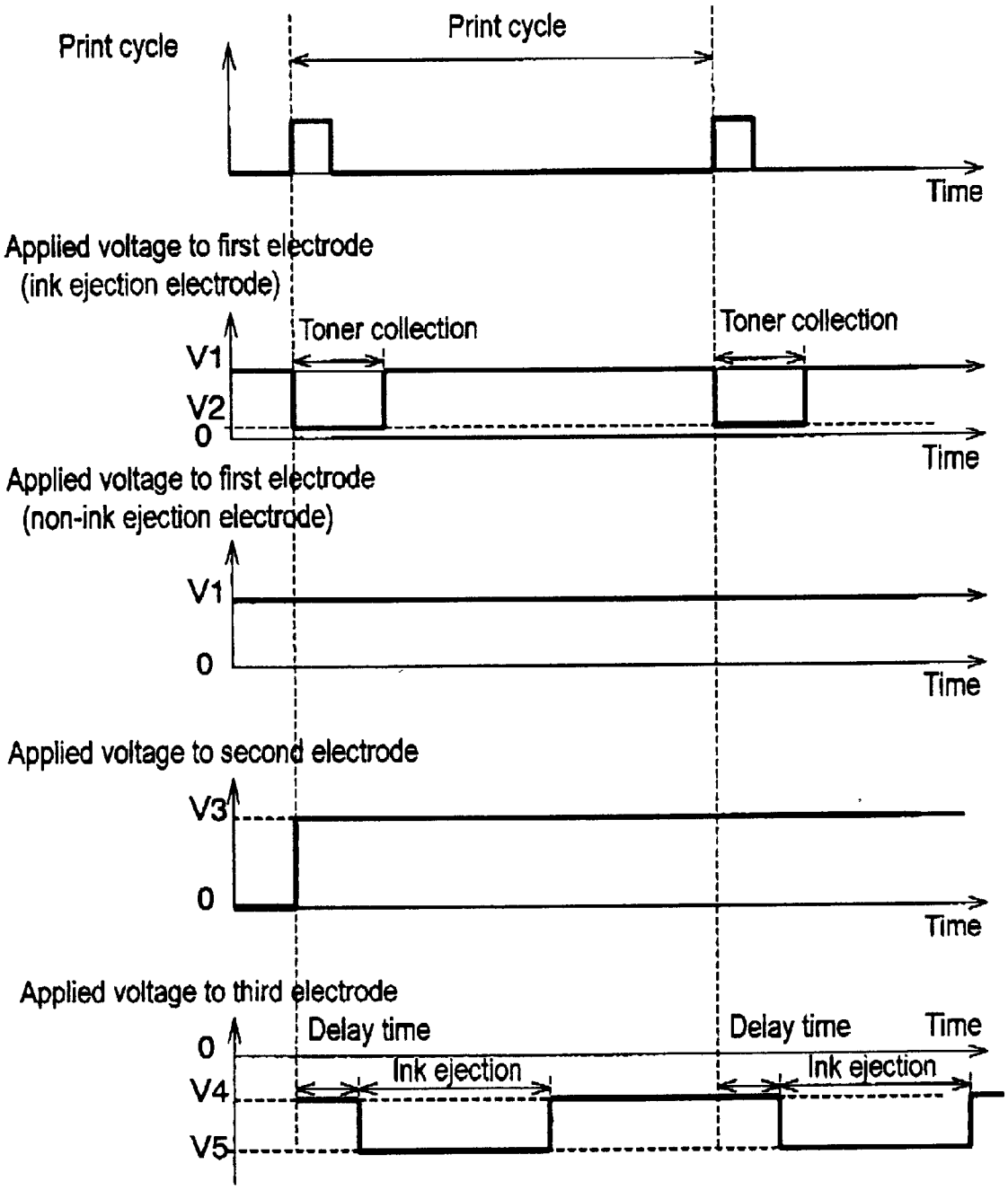
FIG. 9 illustrates control signals of an electrostatic ink jet head in accordance with a sixth exemplary embodiment of the present invention.
Figure 10:
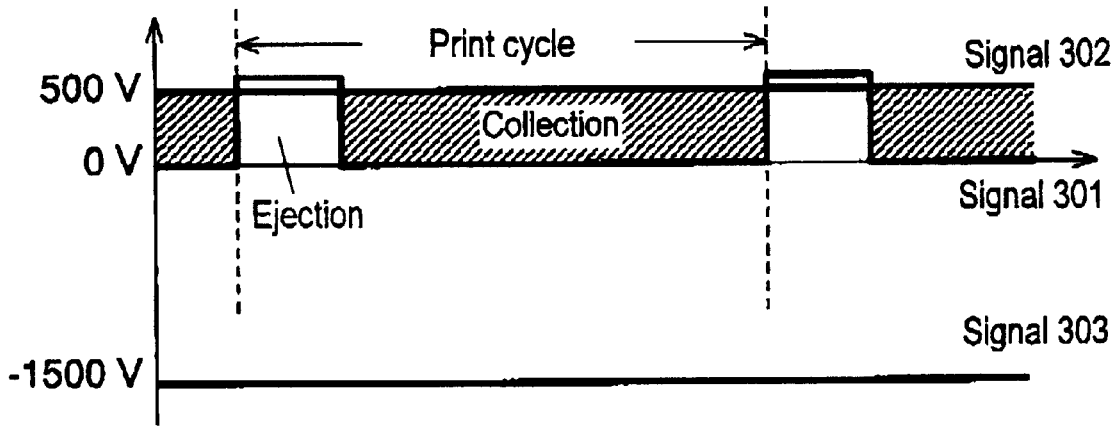
FIG. 10 PRIOR ART
FIGS. 10 and 11 are timing charts illustrating a control system of a conventional electrostatic ink jet head.
Figure 11:
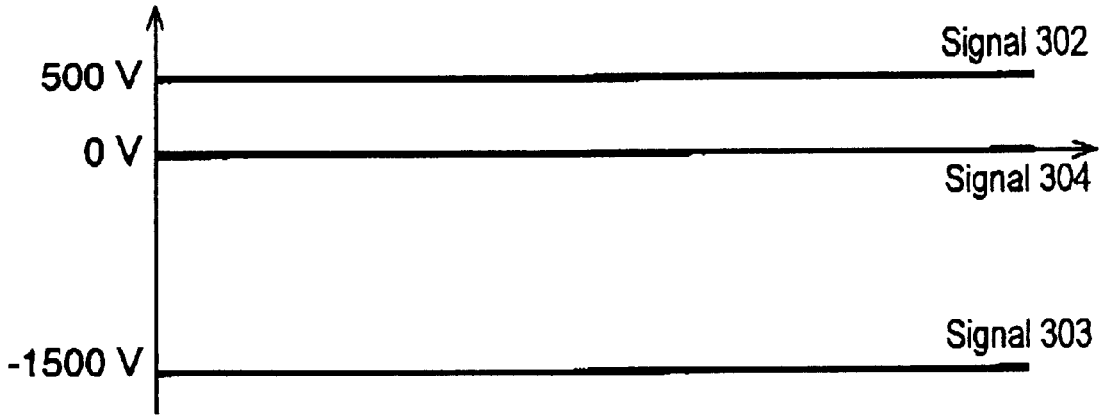
FIG. 11 PRIOR ART

FIG. 9 illustrates control signals of an electrostatic ink jet head in the sixth exemplary embodiment of the present invention.

The configurations of the ink jet head described in the first to third exemplary embodiments are applicable to the sixth exemplary embodiment.

Positive bias voltage V1 is applied to recording electrodes 1, 11, and 21 during the no toner particle attraction period. Signal voltage V2, lower than bias voltage V1, is applied to electrodes for ejecting ink (selected electrodes) in the recording electrodes during the toner particle attraction period. No signals are applied to electrodes which will not eject ink.

Since positive bias voltage V3 is always applied to collecting electrodes 2, 12, and 22, the toner particles are attracted to the selected electrodes by the potential difference between the selected electrodes and collecting electrodes, while signal voltage V2 is applied to the recording electrodes, to set up the ink ejection threshold state.

Negative bias voltage V4 is applied to common electrode 3 except during the ink ejection period, and signal voltage V5, which is lower than bias voltage V4, is applied to common electrode 3 during the ink ejection period after a predetermined delay time elapses from the beginning of the print cycle.

When signal voltage V5 is applied to common electrode 3 after the delay time when the ink ejection threshold state is created at the selected electrodes, the ink is ejected immediately, because the electrostatic attraction is provided after the toner particles have been sufficiently attracted during the delay time. Accordingly, the print frequency and stable printing of small dots are improved. The delay time may be set freely as long as it is within the print cycle. However, it is preferably set to a time between 0 and the attraction period of toner particles.

What is claimed is:

1. An electrostatic ink jet recording apparatus comprising:

(a) a first electrode;

(b) a second electrode, said first and second electrodes adapted for collecting toner particles to be ejected for printing on a recording medium; and (c) a third electrode, said third electrode facing said first and second electrodes via said recording medium, said third electrode not used in said collecting of toner particles;

wherein toner particles are selectively collected with electrostatic force by selectively providing an electrostatic potential difference between said first electrode and said second electrode; and ink including toner particles is ejected for printing onto said recording medium by providing an electrostatic potential to said third electrode.

2. The electrostatic ink jet recording apparatus as defined in claim 1, wherein said second electrode and said first electrode are disposed adjacent to each other on a same plane.

3. The electrostatic ink jet recording apparatus as defined in claim 1, wherein said second electrode is disposed adjacent to said first electrode on a plane vertical to said first electrode.

4. The electrostatic ink jet recording apparatus as defined in claim 1, wherein a positive bias voltage and a negative pulse voltage are applied to said first electrode, and a positive bias voltage is applied to said second electrode.

5. The electrostatic ink jet recording apparatus as defined in claim 1, wherein a positive bias voltage is applied to said first electrode, and a positive pulse voltage is applied to said second electrode.

6. The electrostatic ink jet recording apparatus as defined in claim 1, wherein a signal voltage applied to said third electrode is given after a delay time elapses from a signal voltage applied to at least one of said first electrode and said second electrode.

7. An electostatic ink jet recording apparatus comprising:

(a) a plurality of first electrodes;

(b) a first driver selectively giving potential to said first electrodes;

(c) a second electrode, said first and second electrodes adapted for collecting toner particles to be ejected for printing on a recording medium;

(d) a second driver giving potential to said second electrode;

(e) a third electrode, said third electrode facing said first electrodes and second electrode via said recording medium, said third electrode not used for said collecting of toner particles;

(f) a third driver giving potential to said third electrode; and (g) a controller for controlling said first, second, and third drivers;

wherein said controller controls:

said first and second drivers for applying a predetermined potential to said first and second electrodes for collecting toner particles by selectively providing a potential difference; and said third driver for applying a predetermined potential to said third electrode for ejecting ink including toner particles to print on said recording medium.

8. The electostatic ink jet recording apparatus as defined in claim 7, wherein a positive bias voltage and a negative pulse voltage are applied to said first electrode, and a positive bias voltage is applied to said second electrode.

9. The electrostatic ink jet recording apparatus as defined in claim 7, wherein a positive bias voltage is applied to said first electrode, and a positive pulse voltage is applied to said second electrode.

10. The electrostatic ink jet recording apparatus as defined in claim 7, wherein a signal voltage applied to said third electrode is given after a delay time elapses from a signal voltage applied to at least one of said first electrode and said second electrode.

11. An electrostatic ink jet recording apparatus comprising:

(a) a plurality of first electrodes;

(b) a first driver selectively giving potential to said first electrodes;

(c) a second electrode, said first and second electrodes adapted for collecting toner particles to be ejected for printing on a recording medium;

(d) a second driver giving potential to said second electrode;

(e) a third electrode, said third electrode facing said first electrodes and said second electrode via said recording medium; said third electrode not used for said collecting of toner particles;

(f) a third driver giving potential to said third electrode; and (g) a controller for controlling said first, second, and third drivers;

wherein said controller controls next operations:

creating a first potential difference between a selected electrode for ejecting ink including toner particles in said first electrodes and said second electrode, so as to collect said toner particles around said selected electrode;

creating a second potential difference between a non-selected electrode which does not eject toner particles in said first electrodes and said second electrode, said second potential difference having a smaller electrostatic force than that applied to said toner particles by said first potential difference for reducing attraction of said toner particles around said non-selected electrode; and an electrostatic potential of said third electrode is treated as a second potential that gives greater electrostatic attractive force than said given; first potential with respect to toner particles, so that said toner particles collected to said selected electrode in said first electrodes are ejected for printing characters on said recording medium.

12. The electrostatic ink jet recording apparatus as defined in claim 11, wherein a distance between said first electrode and said second electrode is from 30 to 500 $\mu$m.

13. The electrostatic ink jet recording apparatus as defined in claim 11, wherein a distance between said first electrode and said third electrode is from 0.2 to 3 mm.

14. The electrostatic ink jet recording apparatus as defined in claim 11, wherein a latter edge of a signal applied to said third electrode is dull or gentle than a rising edge.

15. The electostatic ink jet recording apparatus as defined in claim 11, wherein an electrostatic potential difference between said first electrode and said second electrode is from 10 to 500 V.

16. The electostatic ink jet recording apparatus as defined in claim 11, wherein a charge neutralizer for a recording medium is provided at an upstream of a transfer direction of said recording medium of said third electrode.

17. The electostatic ink jet recording apparatus as defined in claim 11, wherein a positive bias voltage and a negative pulse are applied to said first electrode, and a positive bias voltage is applied to said second electrode.

18. The electostatic ink jet recording apparatus as defined in claim 11, wherein a positive bias voltage is applied to said first electrode, and a positive pules voltage is applied to said second electrode.

19. The electrostatic ink jet recording apparatus as defined in claim 11, wherein a signal voltage applied to said third electrode is given after a delay time elapses from a signal voltage applied to at least one of said first electrode and said second electrode.

20. An electrostatic ink jet recording apparatus comprising:

(a) a plurality of first electrodes;

(b) a first driver selectively giving potential to said first electrodes;

(c) a second electrode, said first and second electrodes adapted for collecting toner particles to be ejected for printing on a recording medium;

(d) a second driver giving potential to said second electrode;

(e) a third electrode common to said first electrodes, said third electrode facing said first electrodes and said second electrode via said recording medium; said third electrode not used for said collecting of toner particles;

(f) a third driver giving potential to said third electrode; and (g) a controller for controlling said first, second, and third drivers;

wherein said controller controls next operations:

creating a first potential difference between a selected electrode for ejecting ink including toner particles in said first electrodes and said second electrode, so as to collect said toner particles around said selected electrode;

creating a second potential difference between a non-selected electrode which does not eject toner particles in said first electrodes and said second electrode, said second potential difference having a smaller electrostatic force than that applied to said toner particles by said first potential difference for reducing attraction of said toner particles around said non-selected electrode; and an electrostatic potential of said third electrode is treated as a second potential that gives greater electrostatic attractive force than said given first potential with respect to said toner particles, so that said toner particles collected to said selected electrode in said first electrodes are ejected for printing characters on said recording medium.

* * * * *